US007259759B2

(12) United States Patent
Matsumoto

(10) Patent No.: US 7,259,759 B2
(45) Date of Patent: Aug. 21, 2007

(54) DISPLAY PANEL DRIVE DEVICE

(75) Inventor: Yukihiro Matsumoto, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 592 days.

(21) Appl. No.: 10/841,560

(22) Filed: May 10, 2004

(65) Prior Publication Data

US 2004/0233187 A1 Nov. 25, 2004

(30) Foreign Application Priority Data

May 19, 2003 (JP) ..... 2003-139940

(51) Int. Cl.
*G09G 5/00* (2006.01)

(52) U.S. Cl. ..... 345/212; 345/60; 345/76; 345/98; 315/169.4

(58) Field of Classification Search ..... 345/60, 345/76, 211–213, 98–100; 315/169.4
See application file for complete search history.

(56) References Cited

U.S. PATENT DOCUMENTS 5,663,741 A 9/1997 Kanazawa
5,760,759 A * 6/1998 Tanaka et al. ..... 345/95
6,483,250 B1 11/2002 Hashimoto et al.
6,567,059 B1 * 5/2003 Ide et al. ..... 345/60
6,670,830 B2 * 12/2003 Otsuka et al. ..... 326/86
7,095,391 B2 * 8/2006 Lee ..... 345/87
7,106,319 B2 * 9/2006 Ishiyama ..... 345/211
2003/0214476 A1 * 11/2003 Matsuda et al. ..... 345/100

FOREIGN PATENT DOCUMENTS

EP 0 261 584 A2 3/1988
JP 2000-155557 A 6/2000

* cited by examiner

*Primary Examiner*—Richard Hjerpe
*Assistant Examiner*—Kimnhung Nguyen
(74) *Attorney, Agent, or Firm*—Sughrue Mion, PLLC

(57) ABSTRACT

A display panel drive device capable of preventing a malfunction caused by the influence of electrical charge remaining in a display-panel discharge cell, in which, in parallel with a switching element that connects each electrode of the display panel to a reference potential, at least one of a row electrode drive circuit and a column electrode drive circuit is provided with a parallel switching element that connects each electrode to the reference potential via a current limiting element. The residual charge in the discharge cell on the display panel is discharged via a bypass formed by this parallel switching element within a predetermined period immediately after the device power supply is turned on.

5 Claims, 9 Drawing Sheets

DISPLAY PANEL DRIVE DEVICE

BACKGROUND OF THE INVENTION

1. Field of the Invention

The present invention relates to a display panel drive device for driving a display panel such as a plasma display panel (hereinafter referred to as a 'PDP') or an electroluminescence (hereinafter referred to as 'EL') panel, or the like.

2. Description of the Related Art

Nowadays, thin-type display devices that employ a flat self-illumination-type display panel such as a PDP or EL are being manufactured as the so-called "wall-mount" televisions. Such a technology as that described in Japanese Patent Kokai No. 2000-155557 is known as a display panel drive device of thin-type display devices employing a PDP, for example. Here, the overall constitution of the display panel drive device disclosed in this publication is shown in the block diagram of FIG. 1.

In this figure, the PDP10, which is a display panel, comprises row electrodes $X_1$ to $X_n$ and row electrodes $Y_1$ to $Y_n$, which form a row electrode pair corresponding with each row (the first to $n^{th}$ rows) of a single screen by means of one pair of an X electrode and Y electrode. In addition, column electrodes $Z_1$ to $Z_m$, which are orthogonal to the row electrode pairs and correspond with each column of a single screen (first to $m^{th}$ columns) with a dielectric layer and discharge gap layer (not shown) interposed therebetween, are formed in the PDP10. Further, one discharge cell $C_{(i,j)}$ is formed at the intersection between a pair of row electrodes ($X_i$, $Y_i$) and one column electrode $Z_j$.

Each electrode in the PDP10 is connected to a column electrode drive circuit 20 and row electrode drive circuit 30 or 40, and these electrode drive circuits are drive-controlled by means of commands from a drive control circuit 50.

The overall operation of the display panel drive device shown in FIG. 1 may be described as follows.

First, the row electrode drive circuit 30 generates a positive-voltage reset pulse $RP_y$ and simultaneously applies same to all of the row electrodes $Y_1$ to $Y_n$ as shown in FIG. 2. At the same time, the row electrode drive circuit 40 generates a negative-voltage reset pulse $RP_X$ and simultaneously applies same to each of the row electrodes $X_1$ to $X_n$.

Due to the simultaneous application of the reset pulses $RP_X$ and $RP_Y$, all of the discharge cells of the PDP10 are excited and charged particles are generated. After the discharge has ended, a predetermined amount of barrier charge is formed uniformly in the dielectric layers of all the discharge cells. Incidentally, this processing step is known as the reset step.

After the reset step is complete, the column electrode drive circuit 20 generates pixel data pulses $DP_1$ to $DP_n$ that comply with pixel data corresponding with the first to $n^{th}$ rows of the screen. Subsequently, these pixel data pulses are sequentially applied to the column electrodes $Z_1$ to $Z_m$ as shown in FIG. 2. Meanwhile, the row electrode drive circuit 30 generates a negative-voltage scan pulse SP in accordance with the application timing of each of the pixel data pulses $DP_1$ to $DP_n$. This negative-voltage scan pulse SP is then sequentially applied to the row electrodes $Y_1$ to $Y_n$ with the timing shown in FIG. 2.

Among the discharge cells belonging to row electrodes to which the scan pulse SP is applied, discharge occurs in the discharge cells to which a positive-voltage pixel data pulse DP is simultaneously applied, whereby the majority of the barrier charge is lost. On the other hand, because discharge does not take place in the discharge cells to which the scan pulse SP is applied but to which the positive-voltage pixel data pulse DP is not applied, the barrier charge still remains. Here, discharge cells in which the barrier charge remains are light-emitting discharge cells and discharge cells in which the barrier charge is eliminated are non-light-emitting discharge cells. Incidentally, this processing step is known as the address step.

When the address step is complete, the row electrode drive circuit 30 applies a positive-voltage sustain pulse $IP_y$ serially to each of the row electrodes $Y_1$ to $Y_n$ as shown in FIG. 2. At the same time, the row electrode drive circuit 40 applies the positive-voltage sustain pulse $IP_X$ serially to each of the row electrodes $X_1$ to $X_n$ with timing that is displaced with respect to the application timing for the sustain pulse $IP_Y$. Light-emitting discharge cells, in which the barrier charge still remains over the period during which these sustain pulses $IP_X$ and $IP_Y$ are alternately applied, repeat discharge light emission and retain this light-emitting state. Incidentally, this processing step is known as the sustain step.

Further, in the case of the display panel drive device shown in FIG. 1, the serial processing step described above is repeated for each subfield of the display image.

Further, the first drive control circuit 50 of FIG. 1 generates a variety of switching signals for generating a variety of drive pulses as shown in FIG. 2, based on the synchronization timing contained in the picture signal supplied to this device. Further, these switching signals are supplied to the column electrode drive circuit 20, and row electrode drive circuits 30 and 40 respectively. That is, each of the column electrode drive circuit 20 and the row electrode drive circuits 30 and 40 generate the variety of drive pulses shown in FIG. 2 in accordance with the switching signals supplied by the drive control circuit 50.

The pulse generation circuit, which generates various drive pulses such as the reset pulse $RP_Y$ and sustain pulses $IP_X$ and $IP_Y$, is provided for each of the electrodes in each row and column, in each of the electrode drive circuits described above. Further, these pulse generation circuits all generate the variety of drive pulses above by utilizing the charging of the capacitor by an LC resonance circuit constituted by an inductor L and a capacitor C.

That is, considering that a discharge cell $C_{(i,j)}$ formed on the PDP10 is a capacitive load, a resonance circuit is formed by combining an inductor, which is an inductive element, and a capacitor for power recovery with this discharge cell $C_{(i,j)}$. Further, the desired drive pulse is generated by causing this resonance circuit to oscillate with predetermined timing by opening and closing a switching element such as an FET in accordance with the switching signals supplied by the drive control circuit 50.

As described above, a conventional display panel drive device performs reset discharge processing, such as a display-screen full screen write discharge or a full screen erase discharge, in the reset step that starts a one-field or one-subfield picture display. In other words, it can be deduced that the barrier-charge state of all the discharge cells on the panel is initiated by means of this reset discharge and is included in the writing of data in the subsequent address step.

However, at the time of a transition, such as when the power supply of the display panel drive device is disconnected, cases arise where the voltage value supplied to the circuit of each part in the device drops and control of the variety of discharge states described above is problematic. For example, a situation may also arise where, when the device's power supply is disconnected in the course of a subfield sequence and hence the drive sequence is interrupted, the device is then left with a lot of charge still remaining in the discharge cells on the panel. In this case, there is the risk that, when the power supply of the device is turned on next, the large amount of electrical charge remaining in the discharge cells will flow into each of the electrode drive circuits and render the operation of each electrode drive circuit unstable.

SUMMARY OF THE INVENTION

The present invention was conceived in order to solve these problems, and an example of an object to be resolved by the present invention is that of providing a display panel drive device that makes it possible to prevent a malfunction when the power is turned on that is caused by the residual electrical charge in the discharge cell, for example.

The present invention is a display panel drive device, comprising: a display panel formed by a plurality of row electrode pairs, a plurality of column electrodes arranged to intersect the plurality of row electrode pairs, and capacitive light-emitting elements that are arranged at the respective points of intersection between the row electrode pairs and the column electrodes; a row electrode drive circuit comprising a switching circuit that selectively connects each of the row electrodes constituting the row electrode pairs to a reference potential; and a column electrode drive circuit comprising a switching circuit that selectively connects the column electrodes to the reference potential, wherein at least one of the row electrode drive circuit and the column electrode drive circuit comprises a bypass switching circuit that is connected in parallel with the switching circuit and selectively forms a bypass for the switching circuit via a current limiting element.

DETAILED DESCRIPTION OF THE INVENTION

Figure 1:
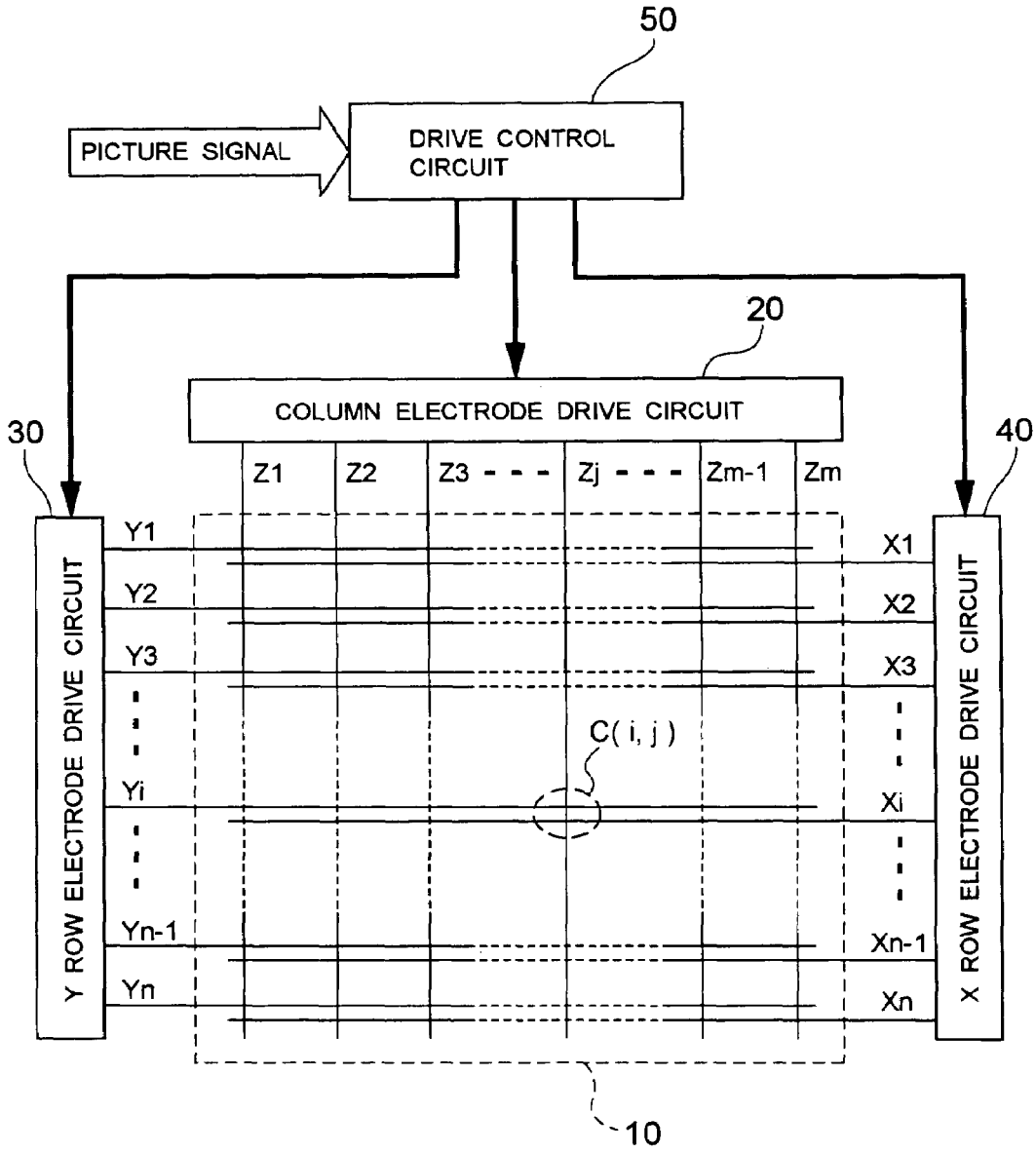
FIG. 1 is a block diagram showing the overall constitution of a conventional PDP display panel drive device.
Figure 2:
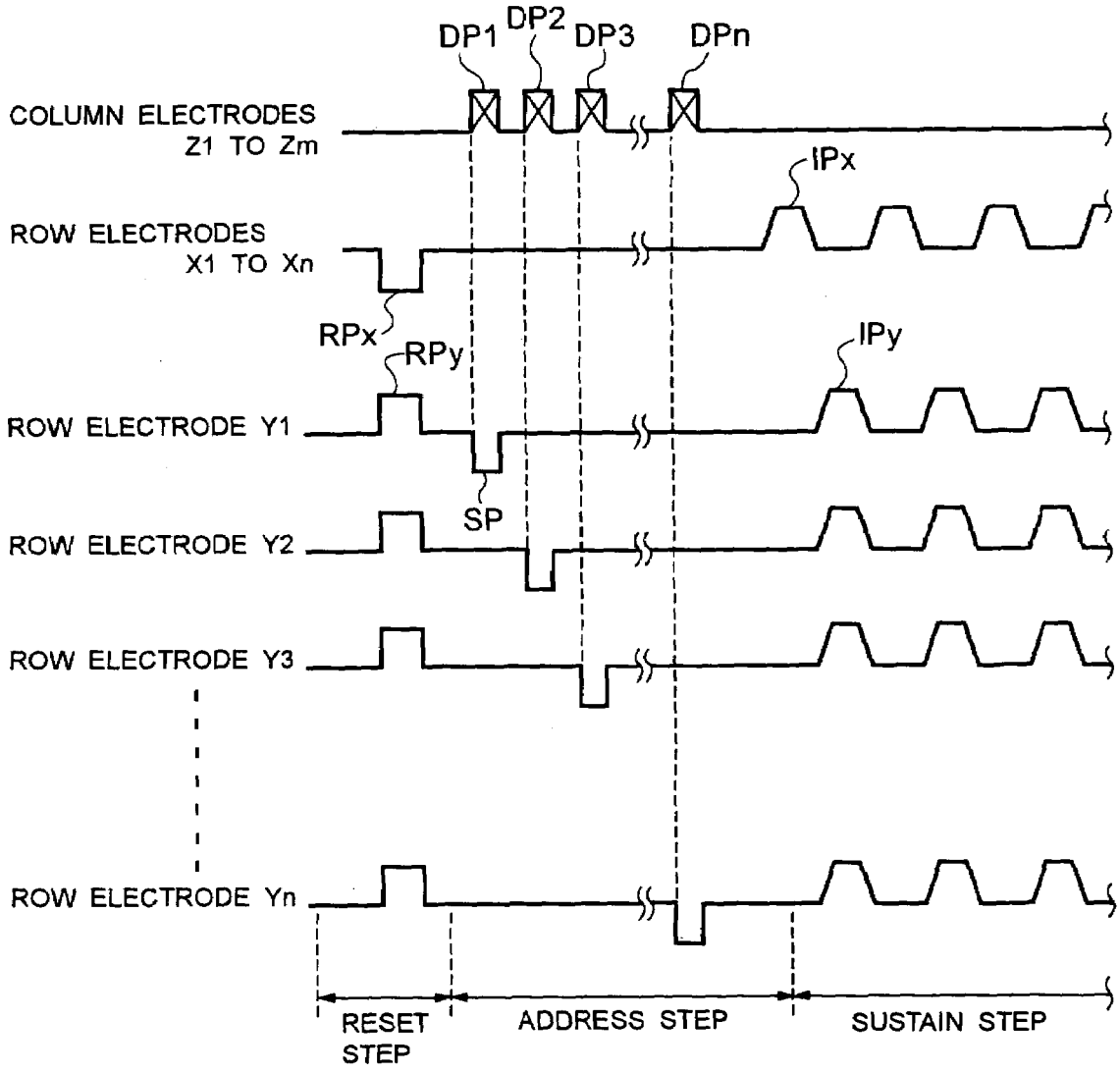
FIG. 2 is a time chart showing the application timing for various drive pulses of the device in FIG. 1.
Figure 3:
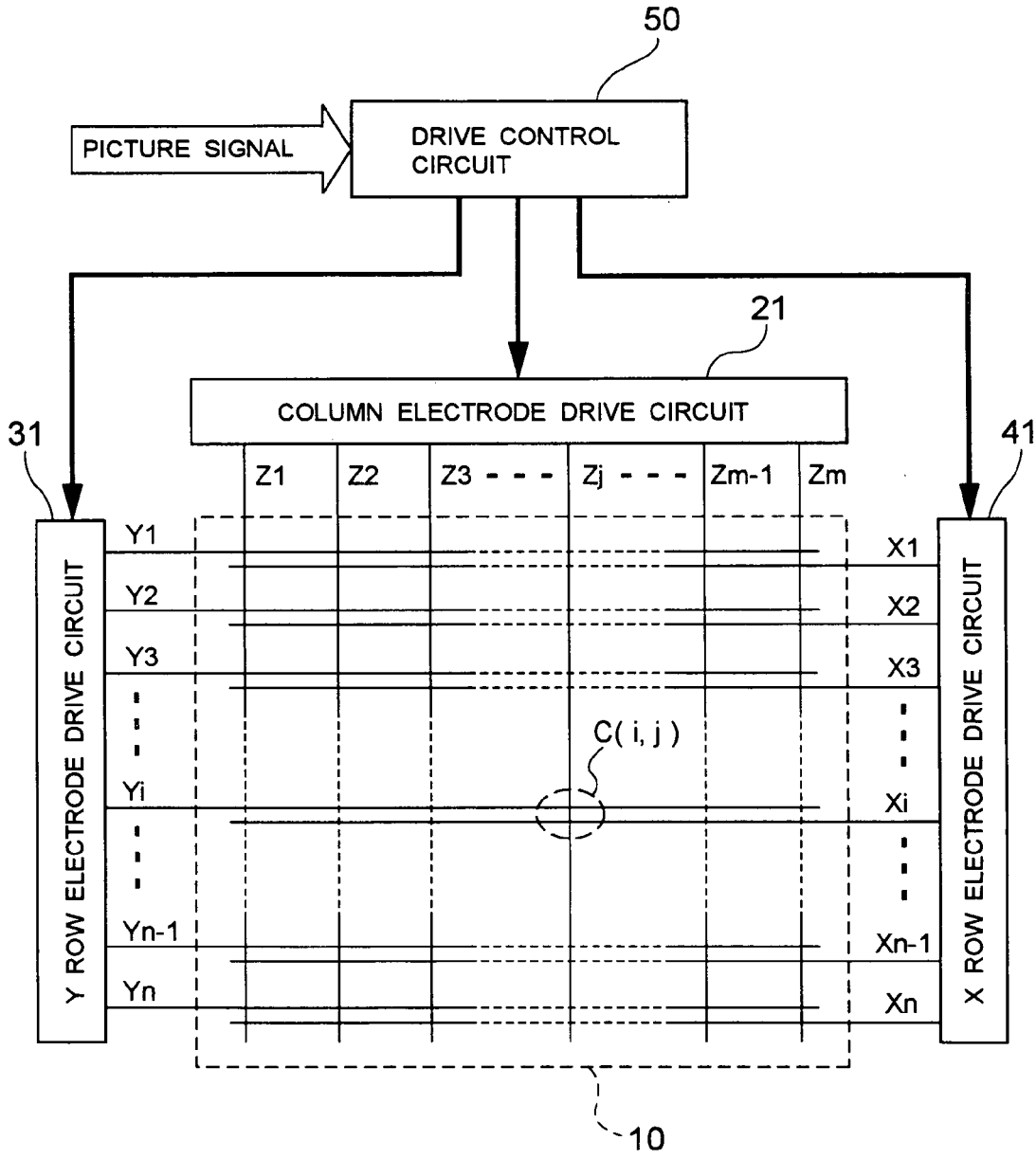
FIG. 3 is a block diagram showing the overall constitution of the display panel drive device of the present invention.

FIG. 3 is a block diagram showing the constitution of a display panel drive device based on the present invention.

In this figure, the PDP10, which is a display panel, comprises row electrodes $X_1$ to $X_n$, and row electrodes $Y_1$ to $Y_n$, which form a row electrode pair corresponding to each row of a single screen (the first to $n^{th}$ rows) by means of one pair of an X electrode and a Y electrode. In addition, column electrodes $Z_1$ to $Z_m$, which are orthogonal to the row electrode pairs and correspond with each column of a single screen (the first to $m^{th}$ rows) with a dielectric layer and discharge gap layer (not shown) interposed therebetween, are formed in the PDP10. Further, one discharge cell $C_{(i,j)}$ is formed at the intersection between one pair of row electrodes ($X_i$, $Y_i$) and one column electrode $Z_j$.

Each of the electrodes in the PDP10 is connected to the column electrode drive circuit 21 and the row electrode drive circuit 31 or 41, and these electrode drive circuits are drive-controlled by commands from the drive control circuit 50.

The row electrode drive circuit 31 generates various drive pulses such as the above-mentioned reset pulse and sustain pulses and applies these pulses to the respective row electrodes $Y_1$ to $Y_n$ with predetermined timing. Similarly, the row electrode drive circuit 41 also generates a variety of drive pulses and applies these pulses to each of the row electrodes $X_1$ to $X_n$ with predetermined timing. Further, the column electrode drive circuit 21 generates a pixel data pulse that complies with the pixel data corresponding to each of the first to $n^{th}$ rows on the screen and sequentially applies these pixel data pulses to the column electrodes $Z_1$ to $Z_m$.

Further, within the row electrode drive circuits 31 and 41 and the column electrode drive circuit 21 respectively, a pulse generation circuit for generating various drive pulses is provided for each electrode in each column and row.

The drive control circuit 50 generates various switching signals for controlling the variety of drive pulses above based on the synchronization timing of the picture signal supplied to the display panel drive device. Further, these switching signals are supplied to the respective pulse generation circuits that are provided within the column electrode drive circuit 21 and row electrode drive circuits 31 and 41 respectively.

Next, the principles of the display panel drive device based on the present invention will be described.

Figure 4:
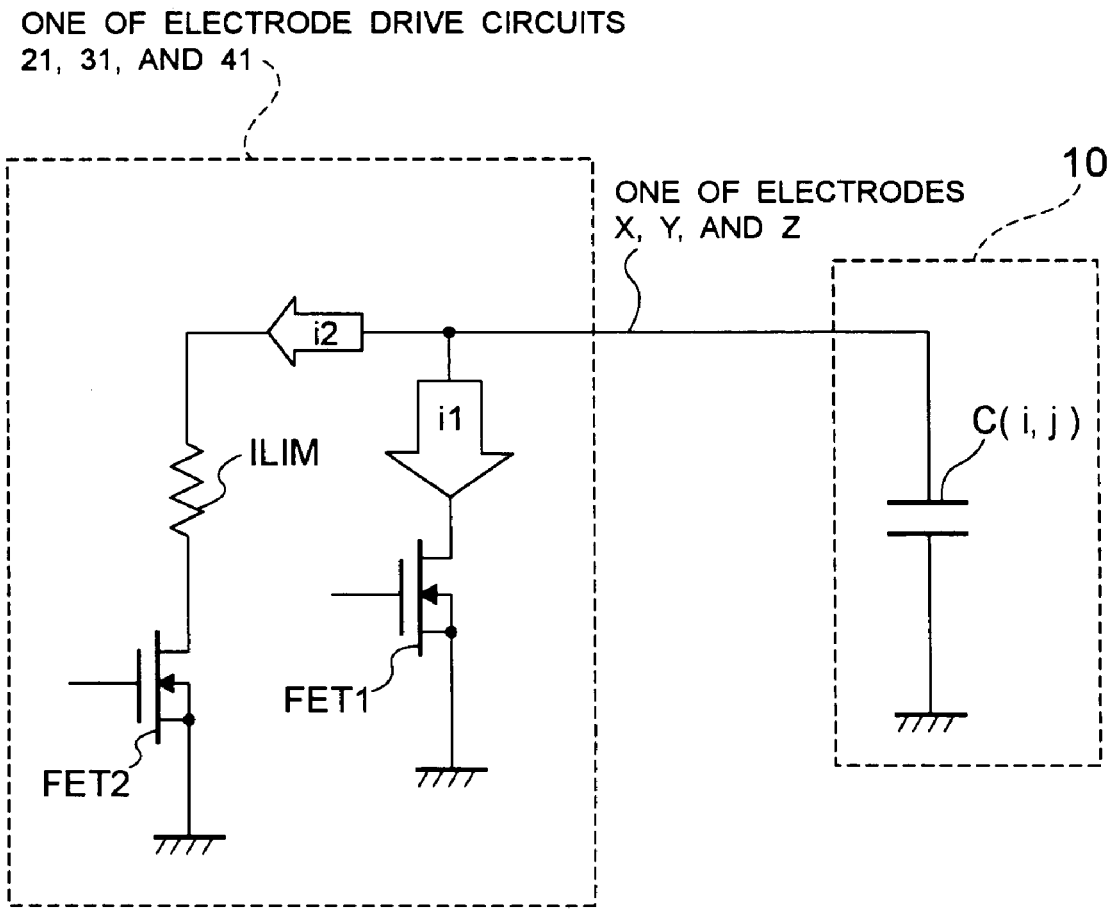
FIG. 4 is a circuit schematic diagram to illustrate the principles of the present invention.

The overall constitution of the output section of the pulse generation circuit, which is provided for each of the column electrodes $Z_1$ to $Z_m$ or each of the row electrodes $X_1$ to $X_n$ and row electrodes $Y_1$ to $Y_n$ in the PDP10 within the column electrode drive circuit 21 and row electrode drive circuits 31 and 41 respectively, is shown in FIG. 4.

As this figure shows, the pulse generation circuit built into all the electrode drive circuits must be provided with a switching element FET1, which connects each electrode connected to this circuit to earth potential (0[V]), which is the reference potential. The present invention is characterized by providing a series circuit constituted by a switching element FET2 and a current limiting element ILIM in parallel with this FET1.

Figure 5A:
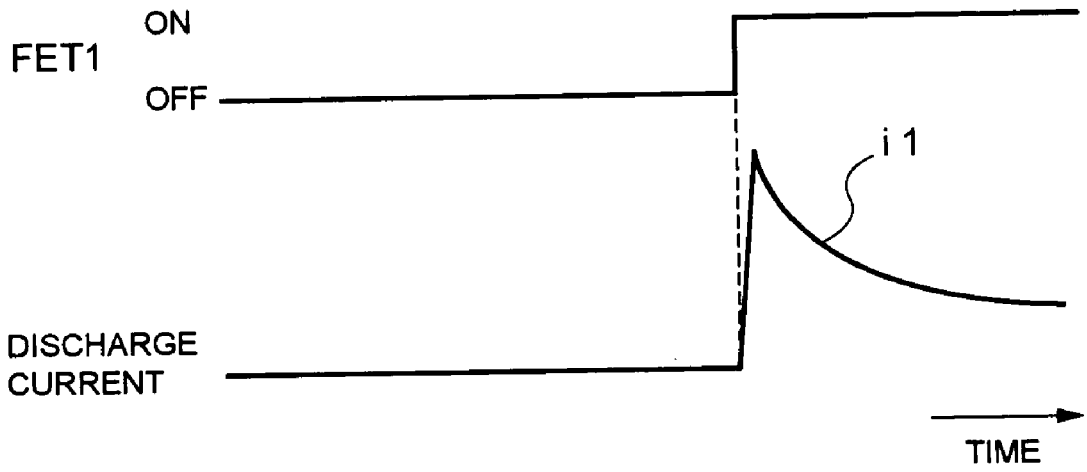
FIGS. 5A and 5B are time charts to illustrate the principles of the present invention.

For example, suppose that the display-panel drive sequence is interrupted by the disconnection of the power supply of the display panel drive device and that electrical charge Q0 then remains in the discharge cells C (i,j) of the PDP10. A case is assumed where, when the power supply is then turned on again, the display-panel drive sequence is executed once again but, in the reset step that is executed immediately after the power supply is turned ON, the FET1 is turned ON with the timing shown in the time chart of FIG. 5A, for example.

Here, because of the residual electrical charge Q0, a discharge current $$i1=\{Q0/C(i,j)\}/r$$

flows from the discharge cell C (i,j) to the FET1. Incidentally, in this equation, Q0/C(i,j) is the voltage induced in the discharge cell C(i,j) by the residual charge Q0, and r represents the DC resistance when the FET1 is ON.

Generally, the DC resistance when the switching element, which is constituted by a semiconductor such as an FET, is ON exhibits an extremely low value. For this reason, there is the risk that the current value permitted by the FET1 will be exceeded when the value of the discharge current i1 is excessive.

Figure 5B:
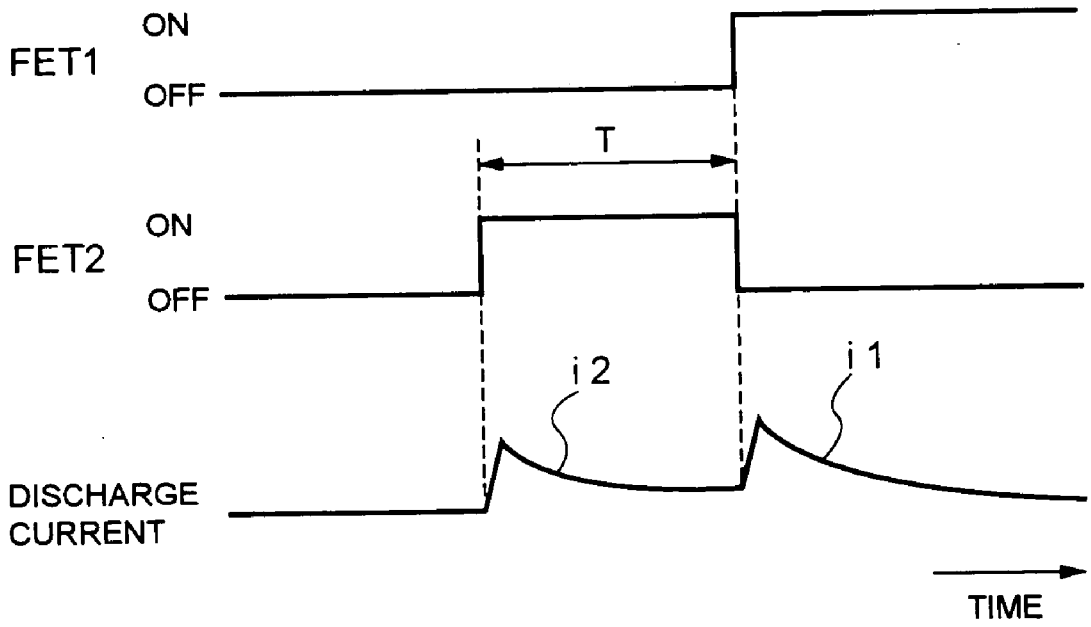

Therefore, a circuit in which the switching element FET2 and the current limiting element ILIM are in series is provided in parallel with the FET1. Immediately before the FET1 is turned ON, ON/OFF control of the FET2 is performed with the timing shown in FIG. 5B.

Here, the discharge current i2, which flows to the FET2 due to the residual electrical charge Q0 in the discharge cell C (i,j) is then:

$$i2=\{Q0/C(i,j)\}/(R+r).$$

R in the above equation indicates the DC resistance value of the current limiting element ILIM. Then, if it is assumed that this R value can be freely adjusted, by presetting this value so that $$R>>r,$$

the value of the discharge current i2 flowing to the FET2 is then:

$$i2<<i1$$

That is, the value of i2 can be accordingly limited at or below a predetermined permitted current value for the FET2.

When the discharge of the residual charge from the discharge cell C(i,j) is started by the series circuit constituted by the FET2 and ILIM, the terminal voltage of the discharge cell drops rapidly as the residual electrical charge is lost. As a result, even when, as shown in the time chart of FIG. 5B, the FET1 is turned ON instead of the FET2 after a time T in which the residual electrical charge of the discharge cell is estimated to be sufficiently small has elapsed, the value of the discharge current i1 at this time can be suppressed to a predetermined value or lower.

That is, by using the constitution described above, the influence of the electrical charge remaining in the discharge cell can be removed and a fault such as a malfunction when the power supply of the display panel drive device is turned on can therefore be prevented.

Further, the current limiting element ILIM in FIG. 4 is not limited to a resistive element. A semiconductor element such as a varistor or thermistor may be used, for example.

Next, the specific constitution of the pulse generation circuit provided in the row electrode drive circuits 31 and 41 and the column electrode drive circuit 21 respectively, which are shown in FIG. 3, will be described with reference to the circuit diagram shown in FIG. 6.

Figure 6:
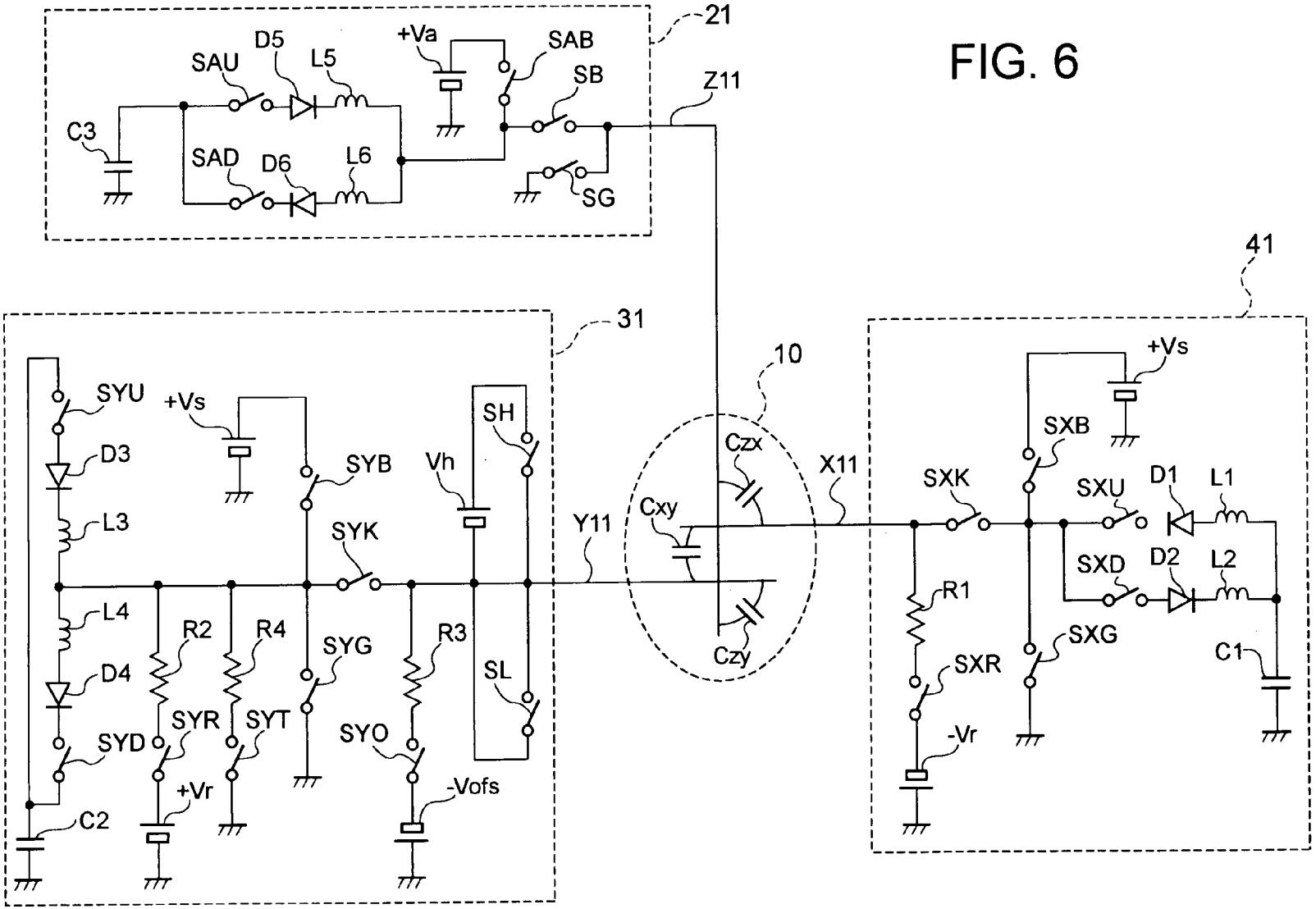
FIG. 6 is a circuit diagram showing a first embodiment of the present invention.

Further, the circuit shown in FIG. 6 shows an embodiment of the present invention. It is understood that the embodiment of the present invention is not limited to this circuit constitution.

Further, the circuit shown in FIG. 6 represents the constitution of a pulse generation circuit relating to one discharge cell on the PDP10, that is, to one row electrode pair and one column electrode. Accordingly, the pulse generation circuit shown in FIG. 6 is provided for each row of the first to $n^{th}$ rows and for each column of the first to $m^{th}$ columns in the PDP10 in the row electrode drive circuits 31 and 41 and the column electrode drive circuit 21.

First, a description will be provided for the constitution of the pulse generation circuit contained in the row electrode drive circuit 31 (Y row electrode drive circuit) in FIG. 6.

In this figure, the positive terminal of a DC supply +Vs is connected to one end of a switch SYB, while the negative terminal is connected to earth potential (0[V]).

Meanwhile, the other terminal of the switch SYB is connected to the respective one end of a switch SYG, a switch SYK, a serial branch constituted by a resistor R4 and switch SYT, a serial branch constituted by a resistor R2, switch SYR and DC supply +Vr, and to the respective one end of a DC branch U3Y and DC branch D4Y. Incidentally, the serial branch U3Y denotes a series circuit comprising an inductor L3, a diode D3 and a switch SYU. Similarly, the serial branch D4Y denotes a series circuit constituted by an inductor L4, a diode D4, and a switch SYD.

Meanwhile, the other end of the switch SYG, the other end of the serial branch constituted by the resistor R4 and switch SYT, and the other end of the serial branch constituted by the resistor R2, switch SYR and DC supply +Vr are each connected to earth potential.

Further, the respective other ends of the serial branch U3Y and serial branch D4Y are both connected to one end of a capacitor C2, while the other end of the capacitor C2 is connected to earth potential. Incidentally, the section comprising the serial branch U3Y, the serial branch D4Y, and the capacitor C2 constitutes a resonance circuit in the pulse generation circuit contained in the row electrode drive circuit 31.

Meanwhile, the other end of the switch SYK is connected to the resistor R3, one end of a serial branch constituted by a switch SYO and a DC supply −Vofs, the negative terminal of a DC supply +Vh, and to one end of a switch SL. Further, the positive terminal of the DC supply +Vh is connected to one end of the switch SH and the positive terminal of the DC supply −Vofs is connected to earth potential.

In addition, the other end of the switch SL and the other end of the switch SH are both connected to a connecting line Y11. Further, the connecting line Y11 is the output terminal for the pulse signal that reaches the Y row electrodes of the PDP10, the capacitive component of the discharge cell $C_{(i,j)}$ of the PDP10 being connected via the Y row electrodes.

Next, the constitution of the pulse generation circuit contained in the row electrode drive circuit 41 (X electrode drive circuit) in FIG. 6 will be described.

In this figure, the positive terminal of the DC supply +Vs is connected to one end of a switch SXB, while the negative terminal is connected to earth potential (0[V]).

Meanwhile, the other terminal of the switch SXB is connected to the respective one end of a switch SXG, a switch SXK, and serial branches U1X and D2X. Incidentally, the serial branch U1X denotes a series circuit comprising an inductor L1, a diode D1 and a switch SXU. Similarly, the serial branch D2X denotes a series circuit comprising an inductor L2, a diode D2, and a switch SXD. Further, the respective other ends of the serial branches U1X and D2X are both connected to one end of the capacitor C1, while the other end of the capacitor C1 is connected to earth potential. Incidentally, the section comprising the serial branches U1X and D2K and the capacitor C1 constitutes a resonance circuit in the pulse generation circuit contained in the row electrode drive circuit 31.

Meanwhile, the other end of the switch SXG is connected to earth potential, and the other end of the switch SXK is connected to a serial branch constituted by a resistor R1, a switch SXR and a DC supply −Vr and to a connecting line X11. The positive terminal of the DC supply −Vr is connected to earth potential.

The connecting line X11 is the output terminal for the pulse signal that reaches the X row electrode of the PDP10, the capacitive component of the discharge cell $C_{(i,j)}$ of the PDP10 being connected via the X row electrode.

Next, the constitution of the pulse generation circuit contained in the column electrode drive circuit 21 (Z electrode drive circuit) in FIG. 6 will be described.

In this figure, the positive terminal of the DC supply +Va is connected to one end of a switch SAB, while the negative terminal is connected to earth potential (0[V]).

Meanwhile, the other terminal of the switch SAB is connected to one end of a switch SB and to the respective one end of serial branches U5A and D6A. Incidentally, the serial branch U5A denotes a series circuit comprising an inductor L5, a diode D5 and a switch SAU. Similarly, the serial branch D6A denotes a series circuit comprising an inductor L6, a diode D6, and a switch SAD. Further, the respective other ends of the serial branches U5A and D6A are both connected to one end of the capacitor C3, while the other end of the capacitor C3 is connected to earth potential. Incidentally, the section comprising the serial branches U5A and D6A and the capacitor C3 constitutes a resonance circuit in the pulse generation circuit contained in the column electrode drive circuit 21.

Meanwhile, the other end of the switch SB is connected to one end of a switch SG and to a connecting line Z11, while the other end of the switch SG is connected to earth potential.

The connecting line Z11 is the output terminal for the pulse signal that reaches the column electrode (Z electrode) of the PDP10, the capacitive component of the discharge cell $C_{(i,j)}$ of the PDP10 being connected via the column electrode.

Further, the capacitances formed between each of the X, Y and Z electrodes of the discharge cell of the PDP10 are defined such that the capacitance between the X and Y electrodes is Cxy, the capacitance between the Z and X electrodes is Czx, and the capacitance between the Z and Y electrodes is Czy.

Next, the operation of the pulse generation circuit shown in FIG. 6 will be described with reference to the time chart in FIG. 7.

The switching element contained in each circuit in FIG. 6 may be constituted by using the channel between the drain and source terminals of a FET, for example, or may be constituted by using another semiconductor element. Incidentally, when an FET is used, ON/OFF control of this switching element is performed by a control signal that is applied to the gate terminal of the FET.

In addition, all the switching elements shown in FIG. 6 are controlled to an ON/OFF state by the control signal supplied by the drive control circuit 50 in FIG. 3. However, in order to simplify the description of the time chart in FIG. 7, the description of the variety of control signals supplied by the drive control circuit 50 is omitted, and only the changes in the ON/OFF states of the switching elements are chronologically shown.

Further, in the following description, all the names of the switching elements are noted simply by symbol names such as SYK, for example. Similarly, all the other elements such as the capacitors and inductors are noted simply with symbols such as C2 and L3, for example.

Figure 7:
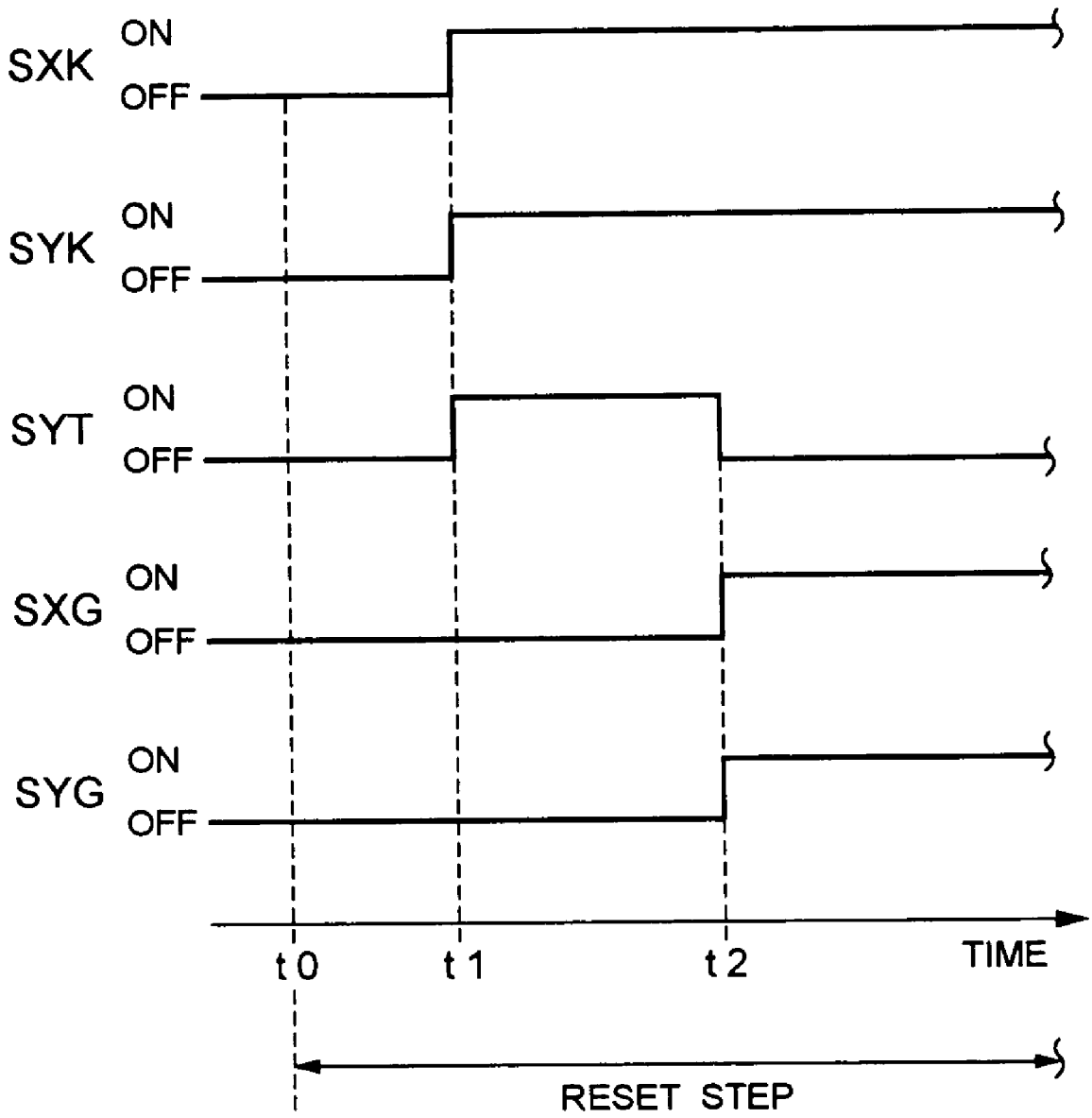
FIG. 7 is a time chart showing an outline of the operation of the circuit in FIG. 6.

It is assumed that the power supply of the display panel drive device is turned on at the time t0 shown in the time chart in FIG. 7. The operation sequence of the display panel drive device is: first, the reset step begins, and, at time t1 after a predetermined time has elapsed after the power is turned on, SYK and SYT in the row electrode drive circuit 31 (Y electrode drive circuit) and SXK in the row electrode drive circuit 41 (X electrode drive circuit) turn ON. It is assumed that SL in the row electrode drive circuit 31 is already ON by time t1.

Because SYK and SXK are ON, the row electrode drive circuits 31 and 41 are each connected to the X row electrode and Y row electrode via the connecting lines X11 and Y11. That is, the inter-electrode capacitance Cxy of the discharge cell in the PDP10 is then connected to the row electrode drive circuits 31 and 41. At the same time, because SYT in the row electrode drive circuit 31 also turns ON, when electrical charge remains in the inter-electrode capacitance Cxy, this residual charge is discharged to earth via the series circuit constituted by R4 and SYT. Incidentally, the value of the discharge current in this case can be contained within a predetermined permissible range by pre-adjusting the resistance value of R4.

Thereafter, at time t2, SYT in the row electrode drive circuit 31 turns OFF, while SYG turns ON, and SXG in the row electrode drive circuit 41 turns ON, meaning that the X row electrode and Y row electrode are directly connected to earth potential via SXG and SYG. Further, at time t2, the majority of the residual charge in the discharge cell has already been discharged via the series circuit constituted by R4 and SYT. Hence, there is no risk of a discharge current that exceeds the permitted value flowing to SXG and SXG.

In the above description, only the sequence immediately after turning on the power supply was described. However, control to turn SYT ON temporarily may be executed at the trailing edge of the reset pulse $RP_y$ that is output by the row electrode drive circuit 31, for example. Accordingly, the series circuit constituted by R4 and SYT can be driven as a so-called 'soft down circuit' that renders the trailing edge of the reset pulse $RP_y$ more moderate.

Figure 8:
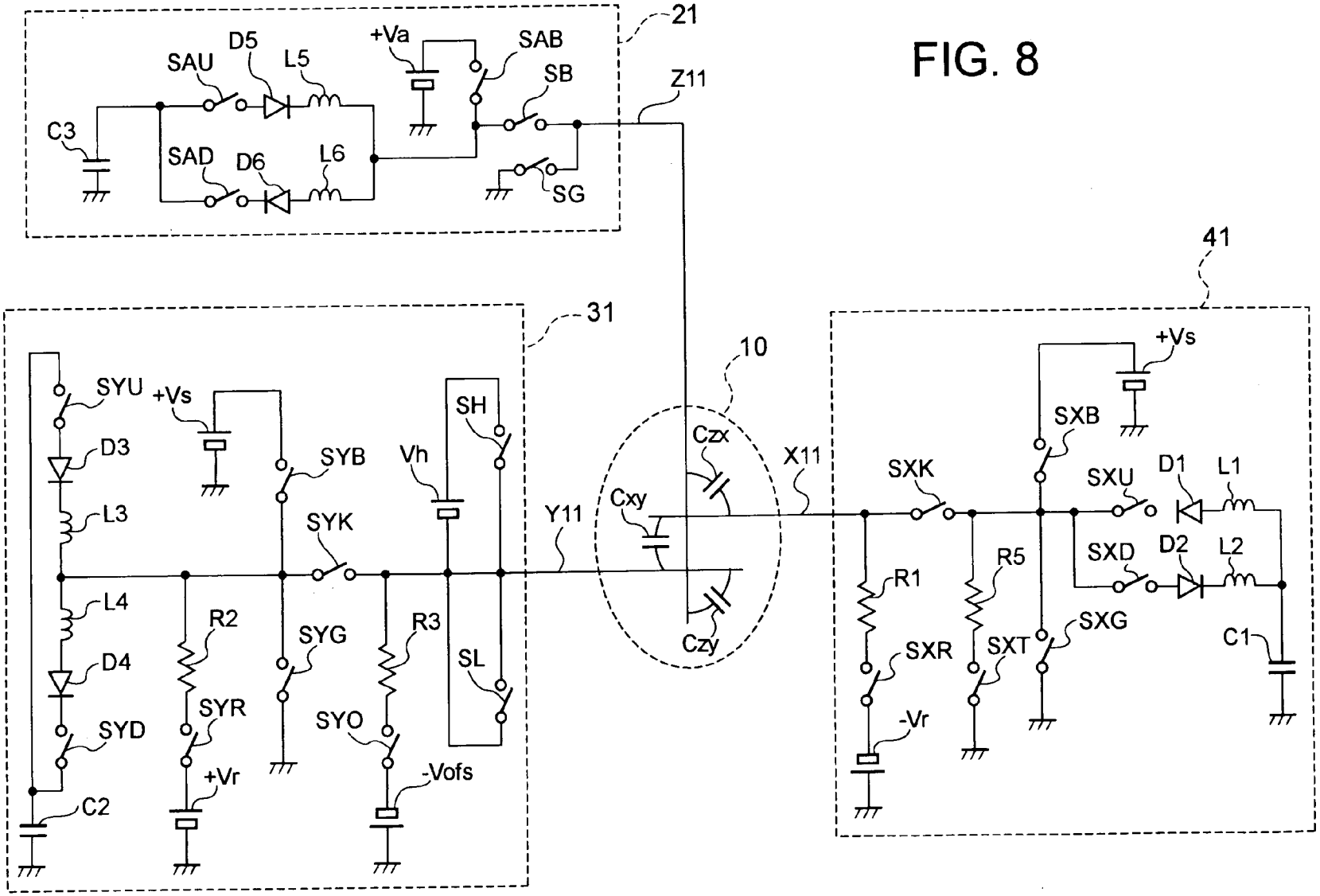
FIG. 8 is a circuit diagram showing a second embodiment of the present invention.

Next, the second embodiment of the display pulse drive device of the present invention is shown in FIG. 8.

The second embodiment provides the row electrode drive circuit 41 (X row electrode drive circuit) with a circuit that is equivalent to the series circuit constituted by SYT and R4 which is provided in parallel with SYG in the row electrode drive circuit 31 (Y row electrode drive circuit) of the first embodiment. That is, a series circuit constituted by SXT and R5 is provided in parallel with SXG in the row electrode drive circuit 41 and, with this series circuit, performs the same operation as the DC circuit constituted by SYT and R4.

Therefore, apart from this difference, the circuit constitution and circuit operation of this embodiment are the same as those of the first embodiment. Hence, a description of the circuit constitution and circuit operation will not be included.

Figure 9:
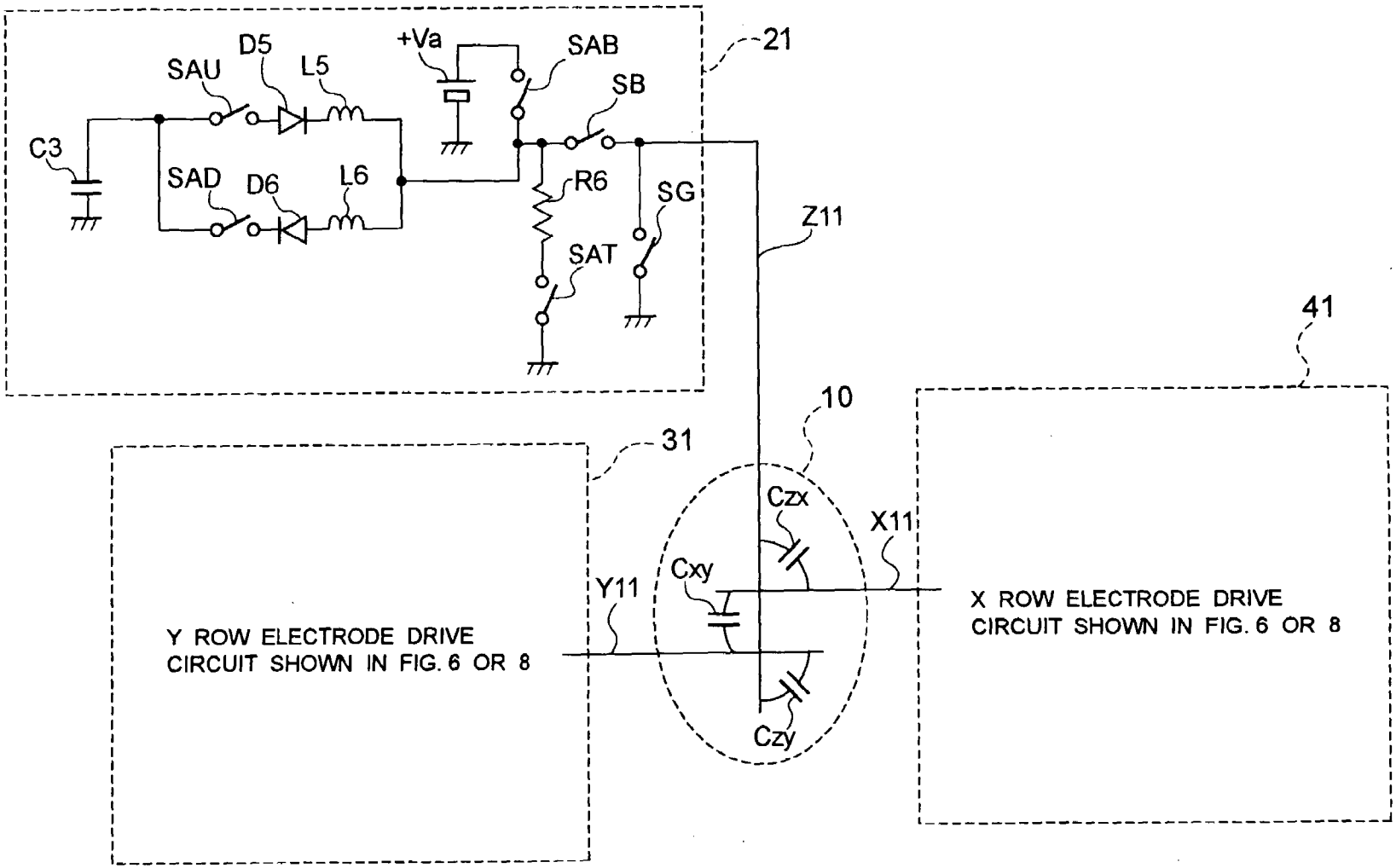
FIG. 9 is a circuit diagram showing a third embodiment of the present invention.

Next, the third embodiment of the display panel drive device according to the present invention is shown in FIG. 9.

The third embodiment is the result of providing a series circuit comprising SAT and R6 in parallel with SG in the column electrode drive circuit 21 (Z electrode drive circuit) in addition to the first embodiment or second embodiment.

That is, in the first and second embodiments, a series circuit, which is constituted by a switching element and current limiting element and forms a bypass for the residual charge of the capacitance between the X and Y electrodes, is provided in the Y-row electrode drive circuit or X-row electrode drive circuit. However, in this embodiment, a circuit forming a bypass for the residual charge in the inter-electrode capacitance is further provided in the column electrode drive circuit.

Therefore, apart from this difference, the circuit constitution and circuit operation of this embodiment are the same as those of the first embodiment and hence a description of the circuit constitution and circuit operation is not included.

This application is based on Japanese Patent Application No. 2003-139940 which is herein incorporated by reference.

What is claimed is:

1. A display panel drive device, comprising:

a display panel formed by a plurality of row electrode pairs, a plurality of column electrodes arranged to intersect the plurality of row electrode pairs, and capacitive light-emitting elements that are arranged at the respective points of intersection between the row electrode pairs and the column electrodes;

a row electrode drive circuit comprising a switching circuit that selectively connects each of the row electrodes constituting the row electrode pairs to a reference potential; and a column electrode drive circuit comprising a switching circuit that selectively connects the column electrodes to the reference potential, wherein:

at least one of the row electrode drive circuit and the column electrode drive circuit comprises a bypass switching circuit that is connected in parallel with the switching circuit and selectively forms a bypass for the switching circuit via a current limiting element.

2. The display panel drive device according to claim 1, wherein the bypass switching circuit forms the bypass within a predetermined period when the power supply of the display panel drive device is turned on.

3. The display panel drive device according to claim 1, wherein the reference potential is earth potential.

4. The display panel drive device according to claim 1, wherein the current limiting element is a resistive element.

5. The display panel drive device according to claim 1, wherein the row electrode drive circuit and column electrode drive circuit each constitute a potential transition circuit based on resonance.

* * * * *